US006558463B2

(12) United States Patent
Hase et al.

(10) Patent No.: US 6,558,463 B2
(45) Date of Patent: May 6, 2003

(54) SOLUTION AND METHOD FOR FORMING A FERROELECTRIC FILM

(75) Inventors: Takashi Hase, Tokyo (JP); Yoichi Miyasaka, Tokyo (JP); Toshinobu Shinnai, Saitama (JP); Hiroshi Morioka, Saitama (JP); Taku Yamate, Saitama (JP); Hayato Katsuragi, Saitama (JP); Kiyoto Mori, Saitama (JP)

(73) Assignees: NEC Corporation (JP); Kanto Kagaku Kabushiki Kaisha (JP)

( * ) Notice: Subject to any disclaimer, the term of this patent is extended or adjusted under 35 U.S.C. 154(b) by 8 days.

(21) Appl. No.: 09/742,825

(22) Filed: Dec. 20, 2000

(65) Prior Publication Data

US 2003/0000422 A1 Jan. 2, 2003

(30) Foreign Application Priority Data

Dec. 20, 1999 (JP) ..... 11-361061

(51) Int. Cl.[7] ..... C09D 183/00; C09D 201/00

(52) U.S. Cl. ..... 106/287.1; 106/287.18; 106/287.19; 106/287.23

(58) Field of Search ..... 106/287.1, 287.18, 106/287.19, 287.23

(56) References Cited

PUBLICATIONS

CAPLUS AN 1991:546484, "Electrochromic niobium pentoxide and niobium . . . " Lee et al, 1991.*

* cited by examiner

*Primary Examiner*—David Brunsman
(74) *Attorney, Agent, or Firm*—D. Peter Hochberg; Katherine R. Vieyra; Sean Mellino

(57) ABSTRACT

A solution for forming a ferroelectric film characterized in that it contains at least one member selected from the group consisting of modified silicone oil and fluorinated surfactants, and a method for forming a ferroelectric film wherein said solution is used. A uniform film free from uneven coating (striation) is formed.

9 Claims, 7 Drawing Sheets

HYSTERESIS CURVE

LEAK CURRENT DENSITY

HYSTERESIS CURVE

LEAK CURRENT DENSITY

SOLUTION AND METHOD FOR FORMING A FERROELECTRIC FILM

FIELD OF THE INVENTION

The present invention relates to a technique for forming a ferroelectric film on a substrate. More specifically, the present invention relates to a solution and a method for forming a uniform ferroelectric film free from uneven coating (striation) on a substrate.

DESCRIPTION OF THE PRIOR ART

Films of lead zirconate titanate (PZT), lead lanthanum zirconate titanate (PLZT), strontium bismuth tantalate (SBT) and other composite oxides can be used for DRAMs, FRAMs and other semiconductor memory devices, as well as for capacitors, sensors, actuators, etc. because of their high dielectricity, ferroelectricity, piezoelectric effect and pyroelectricity.

Solutions prepared from an organic solvent and metal alkoxides having an element constituting the ferroelectric film or other organic metal compounds are used for forming ferroelectric films. Alcohol, ethylene glycol derivatives, xylene etc. can be used as an organic solvent for these solutions; but ethylene glycol derivatives, especially ethylene glycol monomethyl ether are most widely used (JP, 5-319958, A, JP, 7-90594, A).

However, in recent years, the harmfulness of ethylene glycol monomethyl ether and other ethylene glycol derivatives has been being considered to be a problem. Consequently, safety of ethylene glycol derivatives has been actively debated and legislation restricting their use has been introduced in some countries, since their adverse effect on the reproductive function has been discovered. In response to this international trend, in Japan too, there has been a movement, especially in the electronics industry, to restrict the use of ethylene glycol derivatives; hence developing solutions for forming ferroelectric films not employing ethylene glycol derivatives has been desired.

A solution and a method for forming ferroelectric films not using ethylene glycol derivatives are known from JP, 9-278415, A, and JP, 10-226519, A, wherein a low toxic organic solvent having little influence on the reproductive function such as primary alcohol, propylene glycol monomethyl ether or propylene glycol monoethyl ether is used.

However, when using these organic solvents for forming a film on a substrate, especially when the film is formed by the so-called spin coating method in which the substrate placed on a spinner is rotated at a high speed after a solution has been dripped onto it, striation tends to occur, so that it is difficult to form a uniform ferroelectric film.

It is clear that with a capacitor electrode area of several $\mu$m or less, as used in actual electronic devices, striation, which is a stripe-shaped film thickness distribution, causes inhomogeneity of capacitor properties. Consequently, to eliminate such unevenness of device properties' the problem of striation needs to be resolved.

SUMMARY OF THE INVENTION

Accordingly, it is the object of the present invention to solve the before-mentioned problems and to provide a low toxic solution and a method for forming a uniform ferroelectric film free from striation.

As a result of the extensive research to solve the above-mentioned problems, the inventors of the present invention have completed the invention by finding that these problems can be solved by including one or more members selected from the group consisting of modified silicone oil and a fluorinated surfactants in a solution for forming a ferroelectric film using a primary alcohol and/or propylene glycol monoalkyl ether as a solvent.

In other words, the present invention relates to a solution for forming a ferroelectric film prepared from primary alcohol and/or propylene glycol monoalkyl ether and organic metal compounds having an element constituting the ferroelectric film, comprising one or more members selected from the group consisting of modified silicone oil and fluorinated surfactants.

The present invention further relates to the before-mentioned solution, characterized in that the organic metal compounds are 1 or more members selected from the group consisting of lead compounds, zirconium compounds, titanium compounds and lanthanum compounds.

The present invention further relates to the before-mentioned solution, wherein the fluorinated surfactant is a nonionic or an anionic surfactant.

The present invention further relates to the before-mentioned solution, wherein the content of the modified silicone oil is 1 to 100 ppm.

The present invention further relates to the before-mentioned solution, wherein the content of the fluorinated surfactant is 10 ppm to 5%.

The present invention further relates to the before-mentioned solution, characterized in that the ferroelectric is lead zirconate titanate (PZT) or lead lanthanum zirconate titanate (PLZT).

The present invention also relates to a method for forming a ferroelectric film, wherein a solution for forming a ferroelectric film, prepared from primary alcohol and/or propylene glycol monoalkyl ether and organic metal compounds having an element constituting the ferroelectric film, said solution being obtained by including 1 or more members selected from the group consisting of modified silicone oil and fluorinated surfactants, is used for coating a substrate which is subsequently dried and baked.

The present invention further relates to the before-mentioned method, characterized in that the substrate is made from materials including platinum, iridium, iridium oxide, titan, titan oxide, strontium ruthenium oxide (SRO) or indium tin oxide (ITO).

The present invention further relates to the before-mentioned method, wherein the ferroelectric film is a lead zirconate titanate (PZT) and lead lanthanum zirconate titanate (PLZT) film.

The present invention further relates to the before-mentioned method, characterized in that the solution is coated onto the substrate by the spin coating method.

The present invention further relates to the before-mentioned method, characterized in that the drying and baking process consists of drying, prebaking and baking and in that the heating temperatures are higher than 100° C., 300–650° C. and 400–800° C., respectively.

By means of the present invention, it is possible to provide a low toxic solution for forming a uniform ferroelectric film free from striation.

With the solution for forming a ferroelectric film obtained according to the present invention, it is also possible to form a uniform film free from striation by means of the spin coating method.

Further, the solution for forming a ferroelectric film prepared from primary alcohol and/or propylene glycol monoalkyl ether and organic metal compounds having an element constituting the ferroelectric film, signifies a solution comprising components of an organic metal compounds in an organic solvent, for example, a solution in which organic metal compounds have been dissolved in an organic solvent or a solution in which a reaction product has been dissolved in an organic medium, which reaction product can be produced by alcohol exchange reaction (a reaction between organic metal compounds and organic solvents), complex alkoxide forming reaction (a reaction between an alcohol exchange reaction product and an organic metal compound or a reaction between organic metal compounds) or coordination of an organic solvent to a metal atom, etc.

BEST MODES FOR CARRYING OUT THE INVENTION

Figure 1:
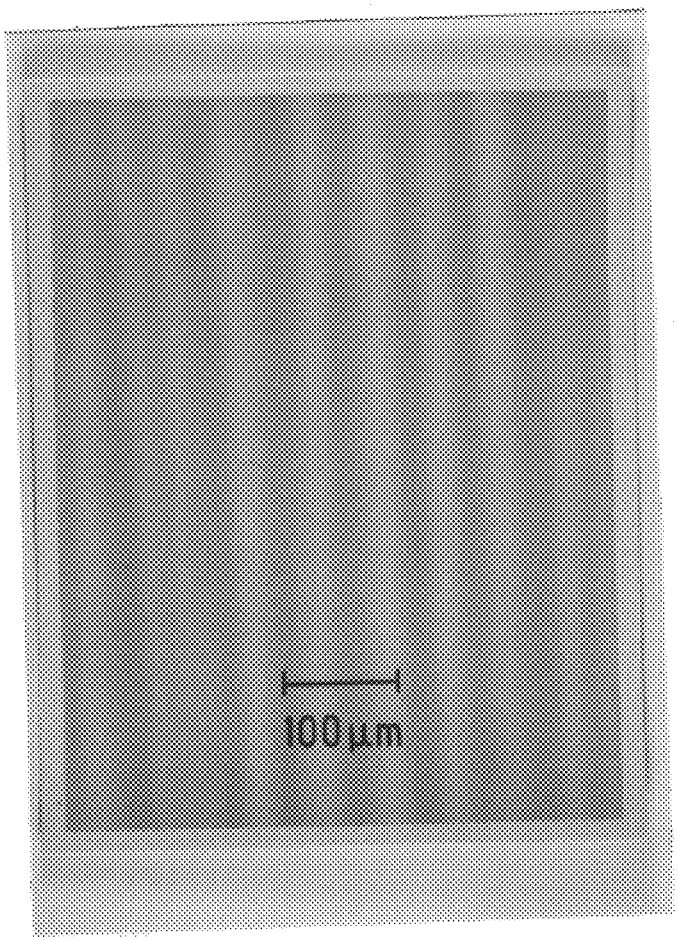
FIG. 1 shows a photograph taken with an optical microscope of Comparative Example 1, in place of a drawing.

The modified silicone oil used in the present invention is dimethyl silicone oil into which an organic group has been introduced. Depending on the organic group introduced, various types of modified products are commercially available. According to the type of modification there are polyether-modified, higher fatty acid-modified, amino-modified and other modified products. As specific examples of commercially available silicone oil can be given polyether-modified products such as TSF-4440, TSF-4441, TSF-4445, TSF-4450, TSF-4446, TSF-4452, TSF-4453, TSF-4460 (all manufactured by Toshiba Silicone Co., Ltd.) and SH-3749 (manufactured by Dow Corning Toray Silicone Co., Ltd.), higher fatty acid-modified products such as TSF-410 and TSF-411 (all manufactured by Toshiba Silicone Co., Ltd.) and amino-modified products such as TSF-4702, TSF-4703, TSF-4706, TSF-4708 (all manufactured by Toshiba Silicone Co., Ltd.). The added amount of silicone oil is preferably 1 to 100 ppm and most preferably 2.5 to 50 ppm.

Next, the fluorinated surfactant used in the present invention can be, depending on its ionization, a nonionic, anionic or cationic surfactant; however, nonionic and anionic surfactants are preferred. Specific examples of nonionic fluorinated surfactants are an alkylester fluoride Florad FC-430 (manufactured by Sumitomo 3M Co., Ltd.), a perfluoroalkyl ethyleneoxide additive Unidyne DS-403 (manufactured by Daikin Industries, Ltd), an oligomer containing a perfluoroalkyl group (hydrophilic group, hydrophobic group) Megaface F-117 (manufactured by Dainippon Ink & Chemicals, Inc.) etc. Specific examples of anionic fluorinated surfactants are a quaternary ammonium salt of perfluoroalkyl sulfonate Florad FC-93 (manufactured by Sumitomo 3M Co., Ltd.) etc. The added amount of fluorinated surfactants is preferably 10 ppm to 5% and most preferably 20 ppm to 1%.

Further, as primary alcohol used in the present invention can be given ethanol, 1-propanol, 1-butanol, isobutyl alcohol, etc.; as propylene glycolmonoalkyl ether can be given propylene glycol monomethyl ether, propylene glycol monoethyl ether etc. These can be used on their own or as a mixture.

Next given are examples of organic metal compounds used as materials of the ferroelectric films according to the present invention. Typical compounds include lead compounds, zirconium compounds, titanium compounds and lanthanum compounds. In addition, any organic metal compound, capable of forming a ferroelectric film, such as strontium compounds, bismuth compounds, tantalum compounds, niobium compounds, iron compounds, aluminum compounds, antimony compounds, barium compounds, calcium compounds, magnesium compounds, etc. can be used.

Examples of lead compounds include lead alkoxides such as lead dimethoxide, lead diethoxide, and lead dibutoxide, etc.; lead acetate trihydrate, lead acetate anhydride, lead 2-ethylhexanoate, lead n-octanate, and lead naphthenate, etc. Preferred compounds are lead acetate trihydrate and lead acetate anhydride.

Examples of zirconium compounds include zirconium tetraalkoxides such as zirconium tetramethoxide, zirconium tetraethoxide, zirconium tetrapropoxide, and zirconium tetrabutoxide etc.; zirconium n-octanate, zirconium naphthenate etc. Preferred compounds are zirconium tetrapropoxide and zirconium tetrabutoxide.

Examples of titanium compounds include titanium tetraalkoxides such as titanium tetramethoxide, titanium tetraethoxide, titanium tetrapropoxide, titanium tetrabutoxide etc. Preferred compounds are titanium tetrapropoxide and titanium tetrabutoxide.

Examples of lanthanum compounds include lanthanum alkoxides such as lanthanum trimethoxide, lanthanum triethoxide and lanthanum tributoxide; lanthanum acetate 1.5 hydrate, lanthanum acetate anhydride, lanthanum 2-ethylhexanoate etc. Preferred compounds are lanthanum acetate 1.5 hydrate and lanthanum acetate anhydride.

With the solution according to the present invention, it is possible to form ferroelectric film excellent in uniformity, by coating said solution onto a substrate before drying, prebaking and baking it. As a substrate, materials including platinum, iridium, iridium oxide, titan, titan oxide, strontium ruthenium oxide (SRO) or indium tin oxide (ITO) and particularly platinum, iridium or iridium oxide can be used. Further, as a coating method, apart from the beforementioned spin coating method, the so-called dipping method, in which a film is formed on a substrate by dipping the substrate into the solution and lifting it out, etc. can be used. Moreover, hot plate heating, hot air heating using an oven or a diffusion furnace, infrared heating, rapid heating (the RTA method) etc. are included as a heating method for the drying, prebaking and baking processes. The heating temperature during drying is 100° C. or more and preferably 120° C. or more. The heating temperatures during prebaking and baking are 300 to 650° C. and 400 to 800° C. respectively. However, since the best heating temperature depends on the type of ferroelectric used, it is necessary to select the most appropriate temperature in each case.

The present invention will now be explained in greater detail by means of Examples and Comparative Examples, without however limiting the present invention to these Examples.

Comparative Example 1

Suspension (A) was prepared by adding and dissolving 0.575 mol of lead acetate trihydrate in 719 g of propylene glycol monomethyl ether, by concentrating the mixture by means of dehydration and by cooling it to the room temperature. While solution (B) was prepared by adding and dissolving 0.20 mol of zirconium tetra-n-propoxide and 0.30 mol of titanium tetraisopropoxide in 625 g of propylene glycol monomethyl ether, by concentrating the mixture by means of dehydration and by cooling it to the room temperature. Thereafter, suspension (A) was mixed and reacted with solution (B) and the mixture was concentrated and cooled to the room temperature. Following this, acetylacetone and water was added, and the mixture was subjected to a hydrolysis reaction and cooled to the room temperature, after which, a solution for forming a PZT film was prepared by passing the mixture through a 0.2 $\mu$m filter.

Figure 2:
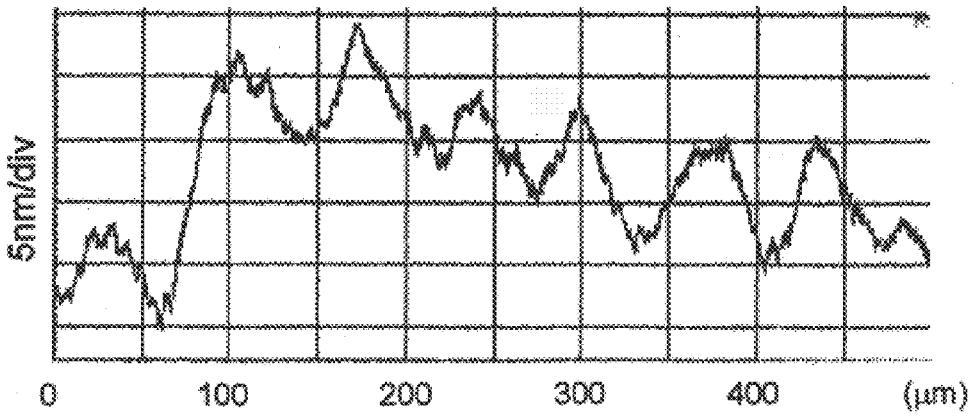
FIG. 2 shows the measured result of the surface roughness of Comparative Example 1.
Figure 3:
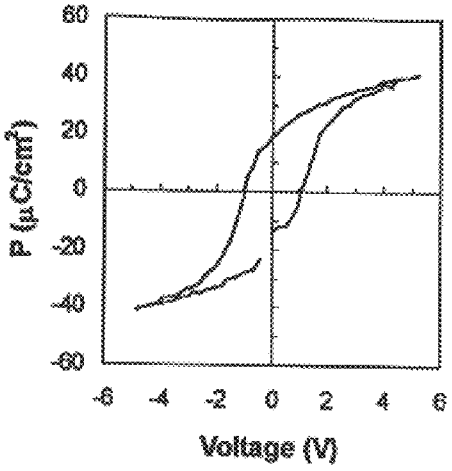
FIG. 3(A) shows the hysteresis curve of Comparative Example 1.
FIG. 3(B) shows the leak current density of Comparative Example 1.
Figure 3:
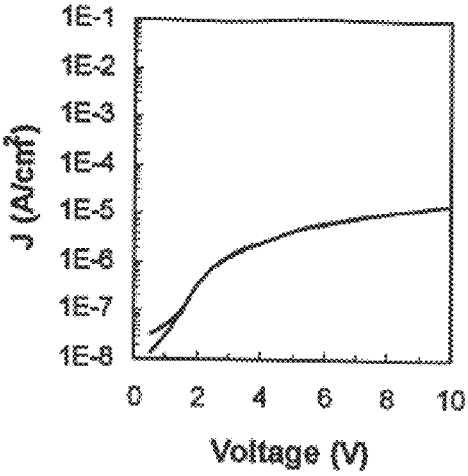

This solution was applied onto a $Pt/Ti/SiO_2/Si$ substrate by spin coating, which was then dried in a clean oven at 250° C. for 30 minutes, whereupon the presence of striation in the coated film was confirmed. Thereafter, the substrate was prebaked in a diffusion furnace at 600° C. for 10 minutes. Following this, the solution was again applied by spin coating, dried and prebaked, after which baking was performed in an oxygen atmosphere in a diffusion furnace at 600° C. for 60 minutes; however, striation was observed and a PZT film with a uniform surface was not obtained FIG. 1 shows the surface of the obtained PZT film observed through an optical microscope. The stripes extending in the vertical direction, placed at an estimated frequency of about 60 to 70 $\mu$m, are the striation. FIG. 2 shows the result of a scanning in the perpendicular direction to these stripes (the direction perpendicular to the straight line passing through the center of spin coating on the surface of the sample: the horizontal direction in FIG. 1) with a surface roughness meter. It was observed that the maximum unevenness of about 20 nm was repeated at a frequency of 60 to 70 $\mu$m. The statistical mean roughness Ra was about 11 nm. These results clearly showed that the striation observed on the obtained PZT film was a stripe shaped film thickness distribution with a frequency of about 60 to 70 $\mu$m. On the surface of this PZT film, 100 $\mu$m square $Ir/IrO_2$ upper layer electrodes were made by etching after sequential deposition of 50 nm of $IrO_2$ and 100 nm of Ir by sputtering. FIG. 3(A) and FIG. 3(B) respectively show the P (polarization)–V (voltage) hysteresis curve and the leak current density of the PZT film capacitance obtained by applying a voltage between the upper electrodes and the Pt electrodes existing at the lower part of the PZT film. With the residual polarization at 5 V of about 20 $\mu C/cm^2$ computed from the hysteresis curve and the leak current density at 5 V of about $4\times10^{-6}$ $A/cm^2$, the PZT film, although striation occurred, showed excellent properties.

The effect of striation (film thickness distribution) had been averaged and there was no impact on capacitor properties, because the 100 $\mu$m square electrodes of ferroelectric capacitors were bigger than the frequency of striation. However, since the size of capacitor electrodes for practical applications is measured in several square $\mu$m or less, the film thickness distribution caused by striation is reflected in the film thickness distribution of each capacitor on the wafer, and as a result, a dispersion of capacitor properties occured.

Comparative Example 2

The solution for forming a PZT film prepared in Comparative Example 1 was used for spin coating a $Pt/IrO_2/SiO_2/Si$ substrate, which was then dried in a clean oven at 150° C. for 30 minutes, whereupon the presence of striation in the coated film was confirmed. Thereafter, the substrate was prebaked in a diffusion furnace at 450° C. for 60 minutes. Following this, the solution was again applied by spin coating, dried and prebaked, after which baking was performed in an oxygen atmosphere in a diffusion furnace at 700° C. for 60 minutes; however, striation was observed and a PZT film with a uniform surface was not obtained.

Comparative Example 3

Suspension (A) was prepared by adding and dissolving 0.055 mol of lead acetate trihydrate and 2.00 g of lanthanum acetate 1.5 hydrate in 150 g of propylene glycol monomethyl ether, by concentrating the mixture by means of dehydration and by cooling it to the room temperature. While solution (B) was prepared by adding and dissolving 0.0260 mol of zirconium tetra-n-propoxide and 0.024 mol of titanium tetraisopropoxide in 115 g of propylene glycol monomethyl ether, by concentrating the mixture by means of dehydration and by cooling it to the room temperature. Thereafter, suspension (A) was mixed and reacted with solution (B) and the mixture was concentrated and cooled to the room temperature. Following this, acetylacetone and water was added, and the mixture was subjected to a hydrolysis reaction and cooled to the room temperature, after which, a solution for forming a PLZT film was prepared by passing the mixture through a 0.2 $\mu$m filter.

This solution was applied onto a $Pt/IrO_2/SiO_2/Si$ substrate by spin coating, which was then dried in a clean oven at 150° C. for 30 minutes, whereupon the presence of striation in the coated film was confirmed. Thereafter, the substrate was prebaked in a diffusion furnace at 450° C. for 60 minutes. Following this, the solution was again applied by spin coating, dried and prebaked, after which baking was performed in an oxygen atmosphere in a diffusion furnace at 700° C. for 60 minutes; however, striation was observed and a PLZT film with a uniform surface was not obtained.

Comparative Example 4

0.020 mol of zirconium tetra-n-propoxide and 0.030 mol of titanium tetraisopropoxide was dissolved in 100 g of ethanol, after which 0.054 mol of lead acetate anhydride was added to and reacted with the mixture, which was then cooled to the room temperature. Following this, acetylacetone and water was added, and the mixture was concentrated by a hydrolysis reaction and cooled to the room temperature, after which, a solution for forming a PZT film was prepared by passing the mixture through a 0.2 $\mu$m filter.

This solution was applied onto a $Pt/IrO_2/SiO_2/Si$ substrate by spin coating; after it had been dried in a clean oven at 150° C. for 30 minutes, the presence of striation in the coated film was confirmed. Thereafter, the substrate was prebaked in a diffusion furnace at 450° C. for 60 minutes.

Following this, the solution was again applied by spin coating, dried and prebaked, after which baking was performed in an oxygen atmosphere in a diffusion furnace at 700° C. for 60 minutes; however, striation was observed and a PZT film with a uniform surface was not obtained.

EXAMPLE 1

A solution for forming a PZT film containing 10 ppm of modified silicone oil TSF-4445 (manufactured by Toshiba Silicone Co., Ltd.) was obtained by adding a propylene glycol monomethyl ether solution in which polyether-modified silicone oil TSF-4445 (manufactured by Toshiba Silicone Co., Ltd.) had been dissolved to the solution for forming a PZT film prepared in Comparative Example 1 and by stirring the mixture for 30 minutes. It was confirmed that the solution had excellent storage stability, since crystallization and gelling caused by aging was not observed and there was almost no change with time in the viscosity of the solution.

This solution was applied onto a $Pt/Ti/SiO_2/Si$ substrate by spin coating, which was then dried in a clean oven at 250° C. for 30 minutes, whereupon a uniform coated film free from striation was obtained. Thereafter, the substrate was prebaked in a diffusion furnace at 600° C. for 10 minutes. Following this, the solution was again applied by spin coating, dried and prebaked, after which baking was performed in an oxygen atmosphere in a diffusion furnace at 600° C. for 60 minutes, so that a uniform 1700 angstrom-thick PZT film free from striation was obtained.

Figure 4:
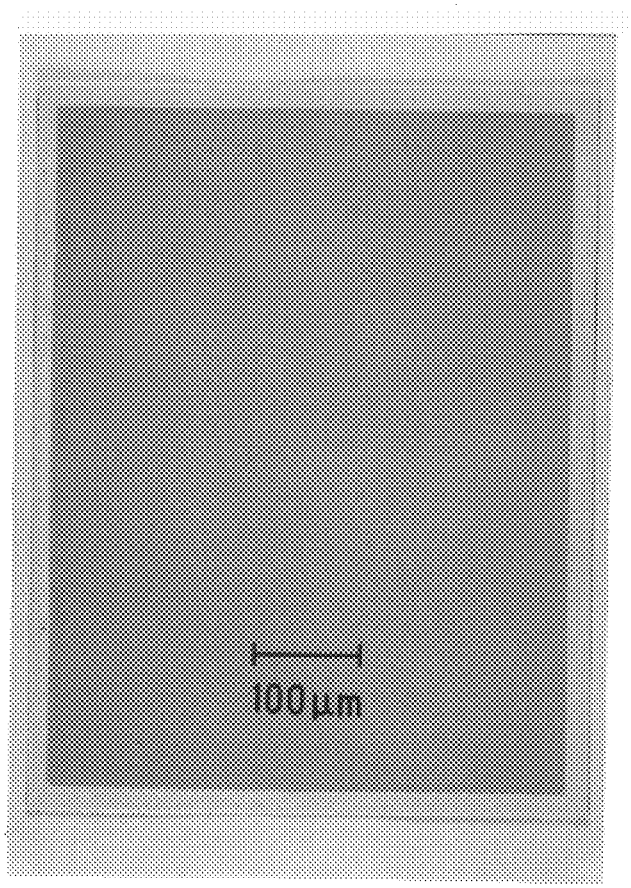
FIG. 4 shows a photograph taken with an optical microscope of Example 1, in place of a drawing.
Figure 5:
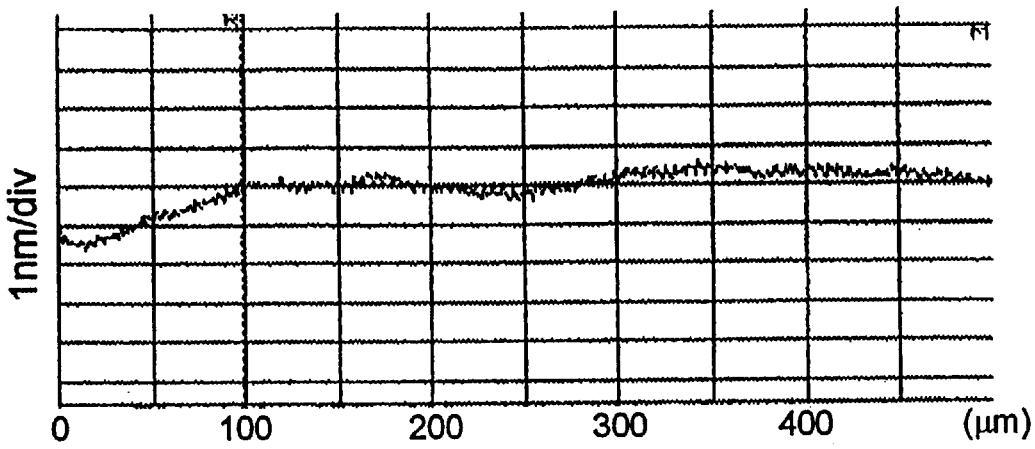
FIG. 5 shows the measured result of the surface roughness of Example 1.
Figure 6:
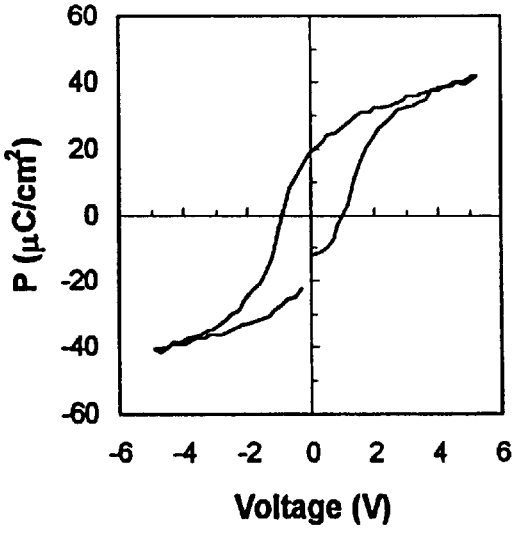
FIG. 6(A) shows the hysteresis curve of Example 1.
FIG. 6(B) shows the leak current density of Example 1.
Figure 6:
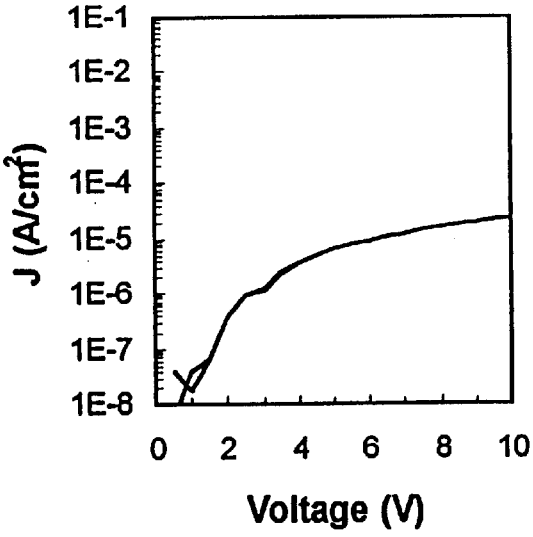

FIG. 4 shows the surface of the obtained PZT film observed through an optical microscope. Even with an optical microscope, stripe shaped coloration was not at all observed. FIG. 5 shows the result of scanning, in the direction perpendicular to the straight line passing through the center of spin coating on the surface of the sample with a surface roughness meter. Even though there was slight irregular unevenness of 0.2 nm or less, a periodic pattern of unevenness, characteristic to striation, was not observed. The statistical mean roughness Ra was about 0.1 nm. From these results, it was confirmed that the PZT film did not have any periodic stripe shaped film thickness distribution to be considered as striation. On the surface of this PZT film, 100 $\mu$m square $Ir/IrO_2$ upper layer electrodes were made by etching after successively depositing 50 nm of $IrO_2$ and 100 nm of Ir by sputtering. FIG. 6(A) and FIG. 6(B) respectively show the P (polarization)–V (voltage) hysteresis curve and the leak current density of the PZT film capacitance obtained by applying a voltage between the upper electrodes and the Pt electrodes existing at the lower part of the PZT film.

The residual polarization at 5 V was about 20 $\mu C/cm^2$ and the leak current density at 5 V was about $5\times10^{-6}$ $A/cm^2$, which was almost identical to the hysteresis curve and leak current properties of Comparative Example 1 shown in FIG. 3(A) and FIG. 3(B). Consequently, it was confirmed that there was almost no change in the electrical properties of a PZT film when 10 ppm of modified silicone TSF-4445 was added.

Moreover, it was also confirmed that there was no deterioration due to the additional of a surfactant.

EXAMPLE 2

The solution for forming a PZT film of Example 1 was applied onto a $Pt/IrO_2/SiO_2/Si$ substrate by spin coating, which was then dried in a clean oven at 150° C. for 30 minutes, whereupon a uniform coated film free from striation was obtained.

Figure 7:
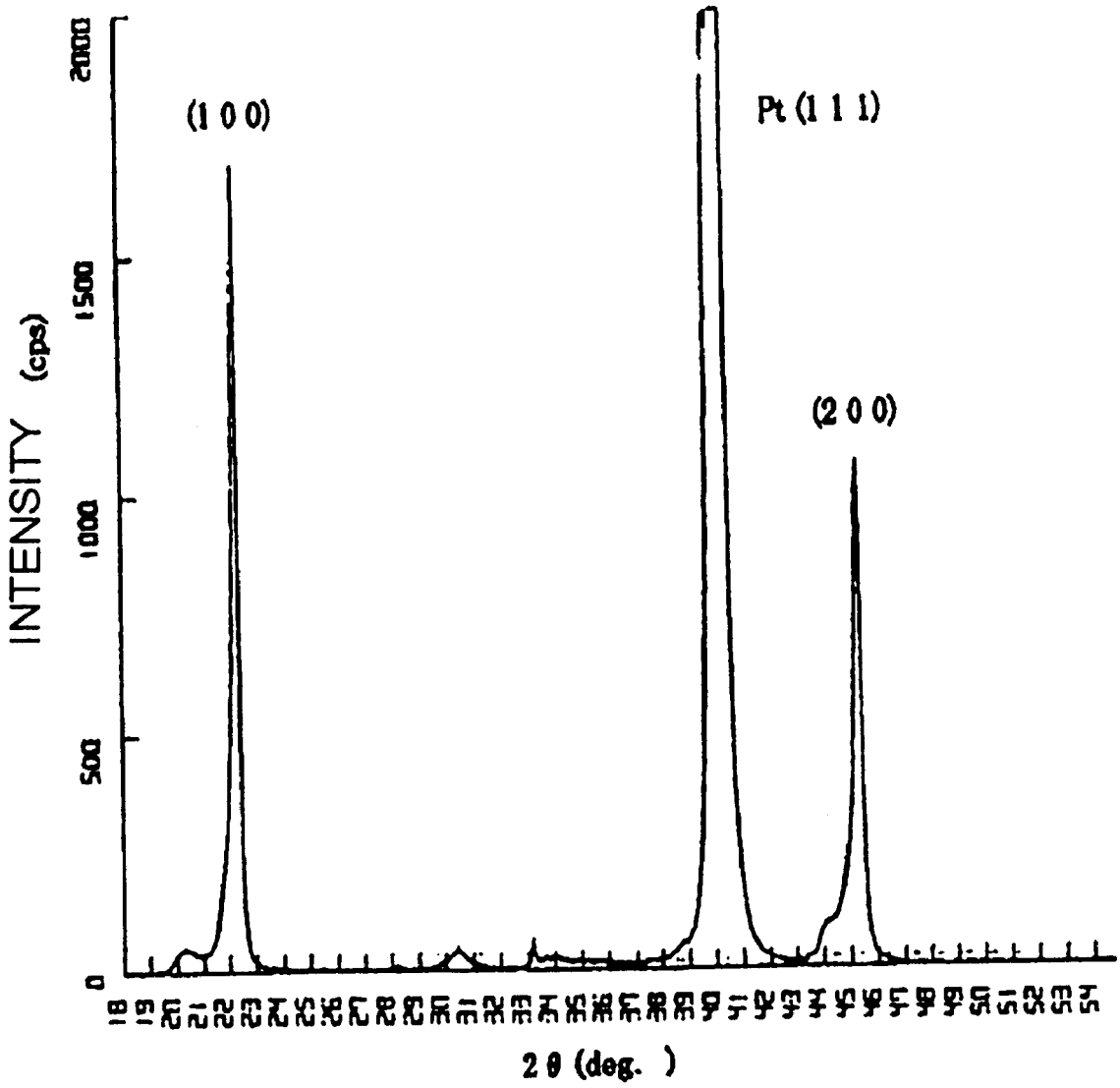
FIG. 7 shows the X-ray diffraction pattern of the PZT film of Example 2.

Thereafter, the substrate was prebaked in a diffusion furnace at 450° C. for 60 minutes. Following this, the solution was again applied by spin coating, dried and prebaked, after which baking was performed in an oxygen atmosphere in a diffusion furnace at 700° C. for 60 minutes, so that a uniform 1700 angstrom-thick PZT film free from striation was obtained. The X-ray diffraction pattern shown in FIG. 7 was obtained by subjecting this film to an X-ray diffraction analysis. It was confirmed that the film had the perovskite structure peculiar to ferroelectrics.

EXAMPLE 3

A solution for forming a PZT film containing 20 ppm of higher fatty acid-modified silicone oil TSF 410 (manufactured by Toshiba Silicone Co., Ltd.) was obtained in the same way as in Example 1. Next, this solution was applied by spin coating onto a $Pt/IrO_2/SiO_2/Si$ substrate, which was then dried in a clean oven at 150° C. for 30 minutes, whereupon a uniform coated film free from striation was obtained. Thereafter, the substrate was prebaked in a diffusion furnace at 450° C. for 60 minutes. Following this, the solution was again applied by spin coating, dried and prebaked, after which baking was performed in an oxygen atmosphere in a diffusion furnace at 700° C. for 60 minutes, so that a uniform 1700 angstrom-thick PZT film free from striation was obtained.

EXAMPLE 4

A solution for forming a PZT film to which 5.0 ppm of amino-modified silicone oil TSF 4703(manufactured by Toshiba Silicone Co., Ltd.) had been added was obtained in the same way as in Example 1. Next, this solution was applied by spin coating onto a $Pt/IrO_2/SiO_2/Si$ substrate, which was then dried in a clean oven at 150° C. for 30 minutes, whereupon a uniform coated film free from striation was obtained.

EXAMPLE 5

A solution for forming a PZT film containing 10 ppm of modified silicone oil TSF-4445 (manufactured by Toshiba Silicone Co., Ltd.) was obtained by adding an ethanol solution in which the polyether-modified silicone oil TSF-4445 had been dissolved to the solution, prepared in Comparative Example 4, for forming a PZT film and by stirring the mixture for 30 minutes. Next, this solution was applied by spin coating onto a $Pt/IrO_2/SiO_2/Si$ substrate, which was then dried in a clean oven at 150° C. for 30 minutes, whereupon a uniform coated film free from striation was obtained.

EXAMPLE 6

A solution for forming a PLZT film containing 10 ppm of modified silicone oil was obtained by adding a propylene glycol monomethyl ether solution in which the polyether-modified silicone oil TSF-4445 (manufactured by Toshiba Silicone Co., Ltd.) had been dissolved to the solution for forming a PLZT film prepared in Comparative Example 3, and by stirring the mixture. It was confirmed that the solution had excellent storage stability, since crystallization and gelling caused by aging was not observed and there was almost no change with time in the viscosity of the solution.

Figure 8:
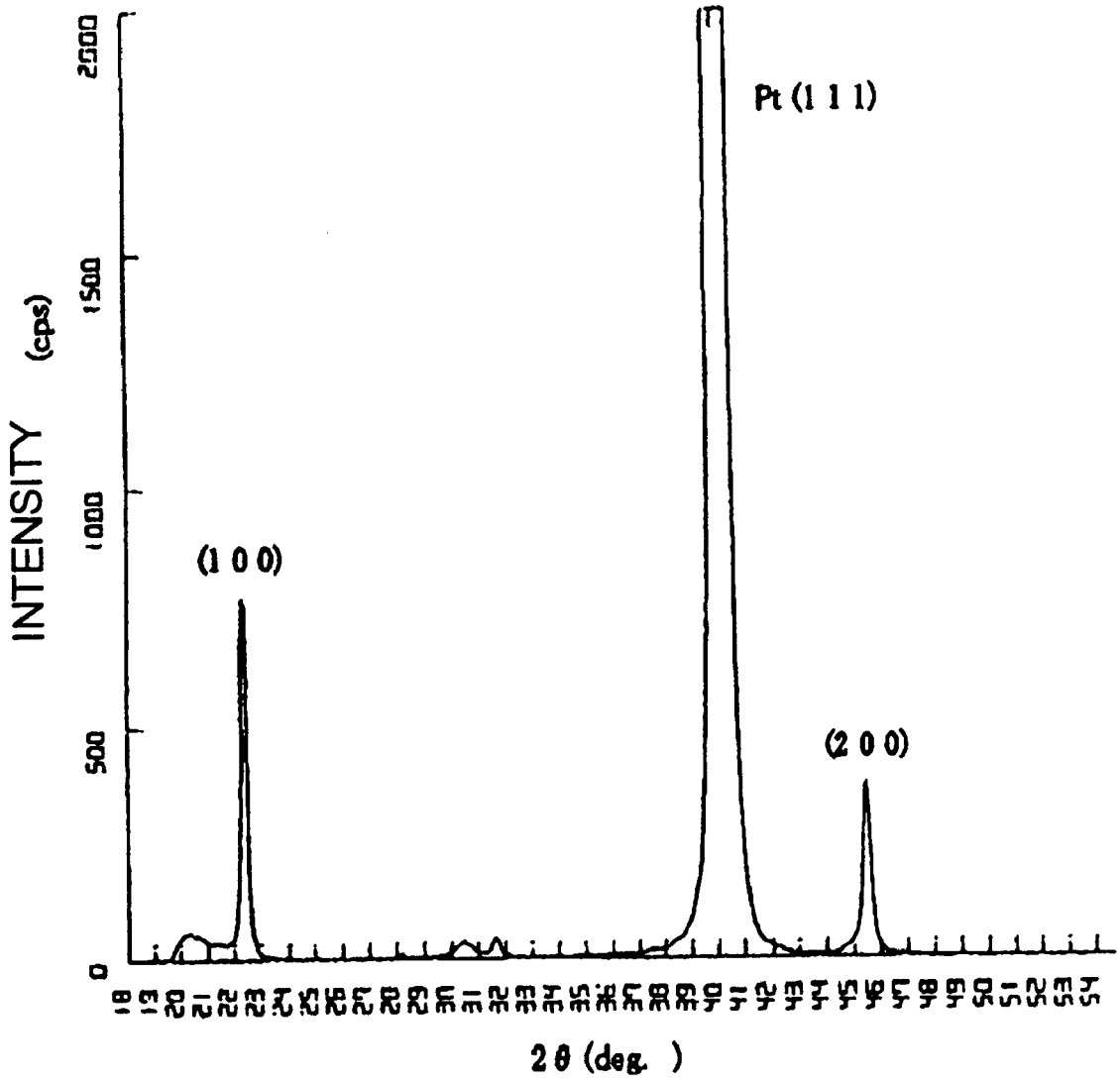
FIG. 8 shows the X-ray diffraction pattern of the PLZT film of Example 6.

Next, this solution was applied by spin coating onto a $Pt/IrO_2/SiO_2/Si$ substrate, which was then dried in a clean oven at 150° C. for 30 minutes, whereupon a uniform coated film free from striation was obtained. Thereafter, the substrate was prebaked in a diffusion furnace at 450° C. for 60 minutes. Following this, the solution was again applied by spin coating, dried and prebaked, after which baking was performed in an oxygen atmosphere in a diffusion furnace at 700° C. for 60 minutes, so that a uniform 1500 angstrom-thick PLZT film free from striation was obtained. The X-ray diffraction pattern shown in FIG. 8 was obtained by subjecting this film to an X-ray diffraction analysis. It was confirmed that the film had the perovskite structure peculiar to ferroelectrics.

EXAMPLE 7

A solution for forming a PZT film containing 10 ppm of a nonionic fluorinated surfactant Florad FC-430 (manufactured by Sumitomo 3M Co., Ltd.) was prepared in the same way as in Example 1.

Figure 9:
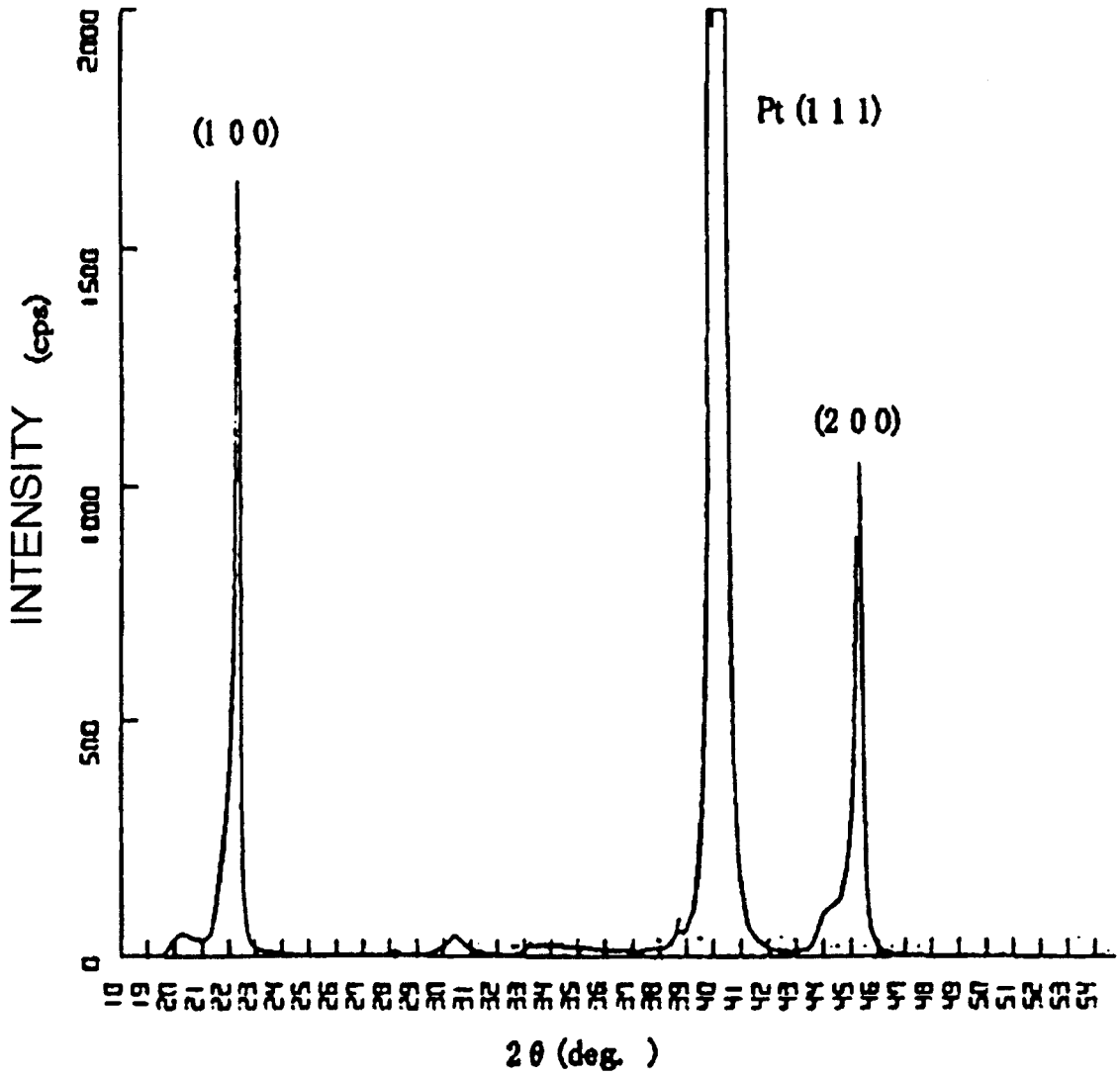
FIG. 9 shows the X-ray diffraction pattern of the PZT film of Example 7.

Next, this solution was applied by spin coating onto a $Pt/IrO_2/SiO_2/Si$ substrate, which was then dried in a clean oven at 150° C. for 30 minutes, whereupon a uniform coated film free from striation was obtained. Thereafter, the substrate was prebaked in a diffusion furnace at 450° C. for 60 minutes. Following this, the solution was again applied by spin coating, dried and prebaked, after which baking was performed in an oxygen atmosphere in a diffusion furnace at 700° C. for 60 minutes, so that a uniform 1700 angstrom-thick PZT film free from striation was obtained. The X-ray diffraction pattern shown in FIG. 9 was obtained by subjecting this film to an X-ray diffraction analysis. It was confirmed that the film had the perovskite structure peculiar to ferroelectrics.

EXAMPLE 8

A solution for forming a PZT film containing 1% of an anionic fluorinated surfactant was obtained by adding an anionic fluorinated surfactant Florad FC-93(manufactured by Sumitomo 3M Co., Ltd.) to the solution for forming a PZT film prepared in Comparative Example 1. Next, this solution was applied by spin coating onto a $Pt/IrO_2/SiO_2/Si$ substrate, which was then dried in a clean oven at 150° C. for 30 minutes, whereupon a uniform coated film free from striation was obtained.

EXAMPLE 9

Figure 10:
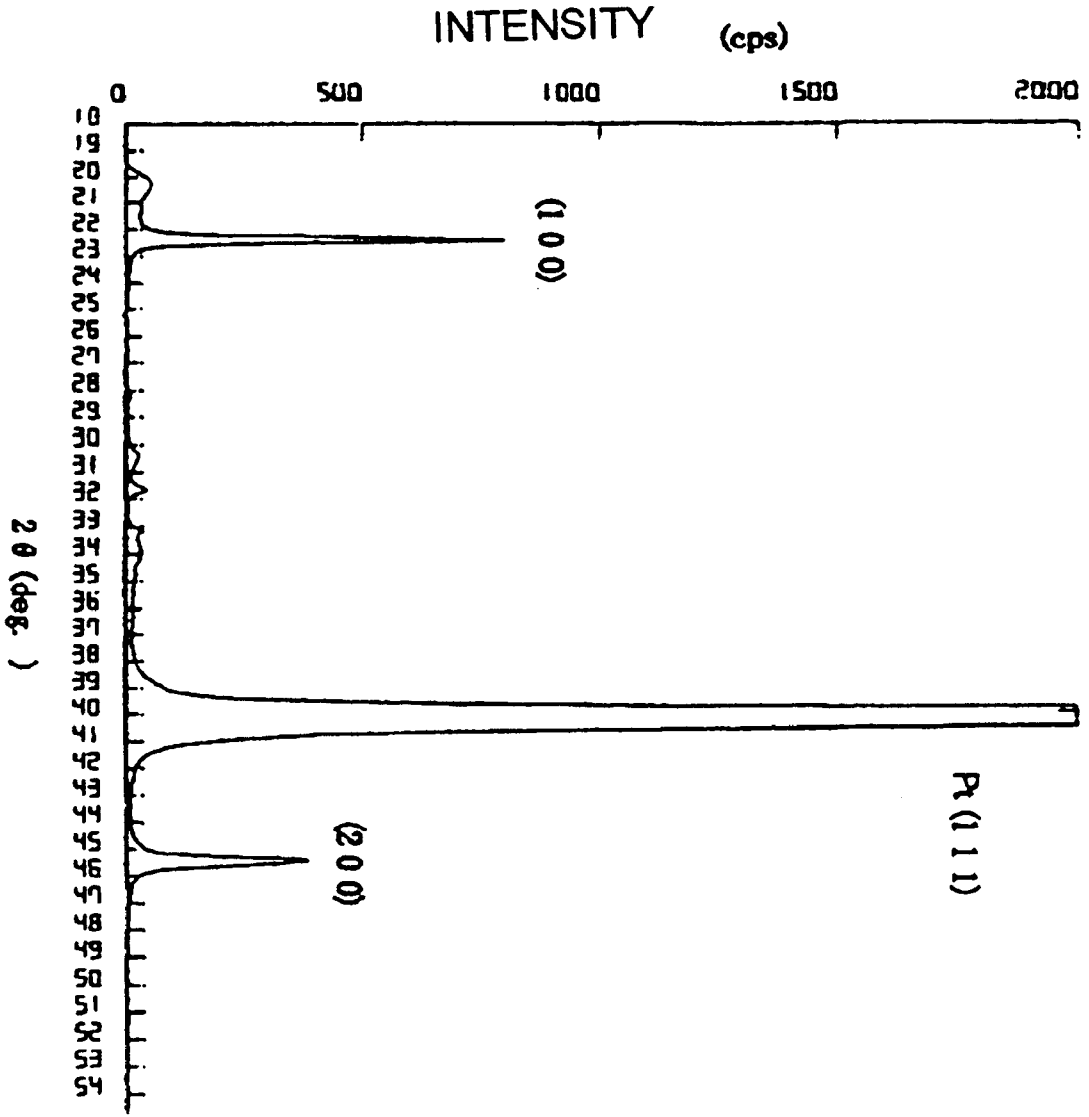
FIG. 10 shows the X-ray diffraction pattern of the PLZT film of Example 9.

A solution for forming a PLZT film containing 10 ppm of a fluorinated surfactant was obtained in the same way as in Example 1 by adding a propylene glycol monomethyl ether solution in which a nonionic fluorinated surfactant Florad FC-430 (manufactured by Sumitomo 3M Co., Ltd.) had been dissolved to the solution, prepared in Comparative Example 3, for forming a PLZT film The solution obtained was applied by spin coating onto a $Pt/IrO_2/SiO_2/Si$ substrate, which was then dried in a clean oven at 150° C. for 30 minutes, whereupon a uniform coated film free from striation was obtained. Thereafter, the substrate was prebaked in a diffusion furnace at 450° C. for 60 minutes. Following this, the solution was again applied by spin coating, dried and prebaked, after which baking was performed in an oxygen atmosphere in a diffusion furnace at 700° C. for 60 minutes, so that a uniform 1500 angstrom-thick PLZT film free from striation was obtained. The X-ray diffraction pattern shown in FIG. 10 was obtained by subjecting this film to an X-ray diffraction analysis. It was confirmed that the film had the perovskite structure peculiar to ferroelectrics.

EXAMPLE 10

A solution for forming a PZT film containing 5 ppm of a modified silicone oil and 5 ppm of a fluorinated surfactant was obtained by adding polyether-modified silicone oil TSF-4445 (manufactured by Toshiba Silicone Co., Ltd.) and a nonionic fluorinated surfactant Florad FC-430 (manufactured by Sumitomo 3M Co., Ltd.) to the solution for forming a PZT film prepared in Comparative Example 1, and by stirring the mixture, in the same way as in Example 1. The solution obtained was applied by spin coating onto a $Pt/IrO_2/SiO_2/Si$ substrate, which was then dried in a clean oven at 150 ° C. for 30 minutes, whereupon a uniform coated film free from striation was obtained.

INDUSTRIAL APPLICABILITY OF THE INVENTION

The solution for forming a ferroelectric film according to the present invention is ideal for forming a ferroelectric film on a substrate because it uses primary alcohol and/or propylene glycol monoalkyl ether, which are organic solvents having low toxicity and little influence on the reproductive function, it has improved coating properties due to the addition of modified silicone oil or of a fluorinated surfactant and also it is available for forming a coated film free from striation even by spin coating.

What is claimed is:

1. A solution for forming a ferroelectric film prepared from one of primary alcohol and propylene glycol monoalkyl ether and organic metal compounds having an element constituting the ferroelectric film, comprising one or more members selected from the group consisting of modified silicone oil and fluorinated surfactants.

2. The solution according to claim 1, wherein the organic metal compounds are one or more members selected from the group consisting of lead compounds, zirconium compounds, titanium compounds and lanthanum compounds.

3. The solution according to claim 1, wherein, the fluorinated surfactant is a nonionic or an anionic surfactant.

4. The solution according to claim 1, wherein the content of the modified silicone oil is 1 to 100 ppm.

5. The solution according to claim 1, wherein the content of the fluorinated surfactant is 10 ppm to 5%.

6. The solution according to claim 1, wherein the ferroelectric is lead zirconate titanate (PZT) or lead lanthanum zirconate titanate.

7. A method for forming a ferroelectric film, wherein a solution for forming a ferroelectric film, prepared from primary alcohol, propylene glycol monoalkyl ether and, organic metal compounds having an element constituting the ferroelectric film, and including one or more members selected from the group consisting of modified silicone oil and fluorinated surfactants, is used for coating a substrate, which is subsequently dried and baked.

8. The method according to claim 7, wherein the ferroelectric film is a lead zirconate titanate (PZT) or a lead lanthanum zirconate titanate (PLZT) film.

9. The method according to claim 7, wherein the solution is applied onto the substrate by spin coating.

* * * * *